US007597066B2

(12) United States Patent
Shimada et al.

(10) Patent No.: US 7,597,066 B2
(45) Date of Patent: Oct. 6, 2009

(54) CIRCULATION TYPE HOT WATER SUPPLY DEVICE

(75) Inventors: Shigeki Shimada, Nagoya (JP); Masakazu Ando, Nagoy (JP)

(73) Assignee: Rinnai Corporation, Nagoya-shi (JP)

( * ) Notice: Subject to any disclaimer, the term of this patent is extended or adjusted under 35 U.S.C. 154(b) by 389 days.

(21) Appl. No.: 11/690,505

(22) Filed: Mar. 23, 2007

(65) Prior Publication Data

US 2007/0257122 A1 Nov. 8, 2007

(30) Foreign Application Priority Data

Mar. 27, 2006 (JP) ..... 2006-085886

(51) Int. Cl.
*F24H 1/10* (2006.01)

(52) U.S. Cl. ..... 122/18.1; 122/406.1; 122/14.22; 237/19

(58) Field of Classification Search ..... 122/106.1, 122/18.1, 14.2, 14.21, 14.22, 40; 126/350.1; 237/2 A, 7, 8 A, 19; 236/11
See application file for complete search history.

(56) References Cited

U.S. PATENT DOCUMENTS 3,647,136 A * 3/1972 Meier ..... 237/8 R
3,770,197 A * 11/1973 Meier ..... 237/8 C
4,501,261 A * 2/1985 Tsutsui et al. ..... 122/14.3
5,203,500 A * 4/1993 Horne, Sr. ..... 237/19
5,571,007 A * 11/1996 Ishiguro et al. ..... 431/13
5,881,952 A * 3/1999 MacIntyre ..... 237/7
6,606,968 B2 * 8/2003 Iwama et al. ..... 122/18.1
7,322,532 B2 * 1/2008 Takada et al. ..... 236/11
7,360,535 B2 * 4/2008 Kobayashi ..... 126/350.1
2007/0257122 A1 * 11/2007 Shimada et al. ..... 237/12
2008/0216770 A1 * 9/2008 Humphrey et al. ..... 122/13.3

FOREIGN PATENT DOCUMENTS

JP 2003-254615 9/2003

* cited by examiner

*Primary Examiner*—Gregory A Wilson
(74) *Attorney, Agent, or Firm*—Rankin, Hill & Clark LLP

(57) ABSTRACT

There is provided a circulation type hot water supply device in which a downstream end of a hot water delivering channel 6 connected to a heat exchanger 4 of a water heater 1 is connected to a water supply channel 5 upstream of the heat exchanger, and a circulating pump 25 that returns hot water fed from the heat exchanger to the hot water delivering channel to the heat exchanger through the water supply channel is provided in the hot water delivering channel. The device can reliably identify an abnormality when it occurs, such as adhesion of a deposit to an inner surface of a heat absorbing pipe 4*b* to reduce heat exchange efficiency. A diagnosis is started when a hot water delivering tap 7 is closed and a burner 3 is subjected to combustion. In the diagnosis, supply of water to the heat exchanger 4 is first stopped to shut down the burner 3. Then, the presence of an abnormality is determined when an amount of increase of a detection temperature from a hot water delivering temperature sensor 20 reaches a predetermined threshold value or more.

6 Claims, 4 Drawing Sheets

CIRCULATION TYPE HOT WATER SUPPLY DEVICE

BACKGROUND OF THE INVENTION

1. Field of the Invention

The present invention relates to a circulation type hot water supply device that circulates hot water through a hot water supply heat exchanger of a water heater even during a stop of delivery of hot water, and has a function of diagnosing abnormalities of the heat exchanger at early stages.

2. Description of the Related Art

A conventional water heater comprises a hot water supply heat exchanger, a burner that heats water supplied to the heat exchanger from a water supply channel upstream of the heat exchanger, and delivered hot water temperature detection means for detecting a temperature of hot water fed from the heat exchanger to a hot water delivering channel downstream of the heat exchanger. A combustion amount of the burner is controlled so that a delivered hot water temperature detected by the delivered hot water temperature detection means reaches a set hot water temperature set by a remote controller.

Another conventional water heater comprises a flow rate sensor and a flow rate control valve provided in a water supply channel, and supplied water temperature detection means for detecting a temperature of water supplied through the water supply channel to a heat exchanger. In this water heater, a combustion amount required for increasing a delivered hot water temperature to a set hot water temperature is calculated from a deviation between a delivered hot water temperature detected by delivered hot water temperature detection means and a supplied water temperature detected by the supplied water temperature detection means, and a water supply amount detected by the flow rate sensor, and a combustion amount of a burner is controlled by feedforward control. If the delivered hot water temperature is not increased to the set hot water temperature even with a maximum combustion amount of the burner, the water supply amount is reduced by the flow rate control valve.

Immediately after opening of a hot water delivering tap connected to a hot water delivering channel, cold water remaining in the hot water delivering channel between the heat exchanger and the hot water delivering tap flows out from the hot water delivering tap, which causes discomfort to a user. A conventional circulation type hot water supply device for solving such a problem is also known. In such a hot water supply device, a downstream end of a hot water delivering channel is connected to a water supply channel, and a circulating pump that returns hot water fed from a heat exchanger to a hot water delivering channel to the heat exchanger through the water supply channel is provided in the hot water delivering channel. In this device, water is supplied to the heat exchanger by an operation of the circulating pump even after the hot water delivering tap is closed to stop delivery of hot water, thereby causing combustion of a burner. This allows a temperature of the hot water in the hot water delivering channel to be maintained at an appropriate temperature, and allows the hot water at the appropriate temperature to be delivered immediately after the opening of the hot water delivering tap.

In areas with high water hardness, $CaCO_3$ or $MgCO_3$ contained in water is deposited in a heat absorbing pipe of a heat exchanger, and a deposit easily adheres to an inner surface of the heat absorbing pipe. Adhesion of the deposit reduces heat exchange efficiency of the heat exchanger to make it difficult for combustion heat of a burner to be absorbed by water, thereby increasing a temperature of the heat exchanger itself.

Repeating combustion in this state causes heat damage to the heat exchanger and thus causes leakage.

Japanese Patent Laid-Open No. 2003-254615 discloses a simple water heater that is not of a circulation type that can identify abnormalities of a heat exchanger at early stages based on an amount of increase of a detection temperature from delivered hot water temperature detection means after a hot water delivering tap is closed to stop combustion of a burner (so-called, an amount of delayed water temperature increase). If adhesion of a deposit to an inner surface of a heat absorbing pipe reduces heat exchange efficiency of the heat exchanger to increase a temperature of the heat exchanger itself as described above, the detection temperature from the delivered hot water temperature detection means is significantly increased after a stop of delivery of hot water. Thus, the presence of an abnormality can be determined when the amount of increase of the detection temperature from the delivered hot water temperature detection means after the stop of the delivery of hot water reaches a predetermined threshold value or more.

It is desired to identify abnormalities of a heat exchanger at early stages using such a technique in a circulation type hot water supply device. Some circulation type hot water supply devices always drive a circulating pump. In such a device, water is supplied to a heat exchanger by an operation of a circulating pump even after a hot water delivering tap is closed to stop combustion of a burner, thereby causing no delayed water temperature increase of the heat exchanger. Thus, even if a deposit adheres to an inner surface of a heat absorbing pipe, a detection temperature from delivered hot water temperature detection means is not increased after a stop of delivery of hot water, and abnormalities of the heat exchanger cannot be identified based on an amount of increase of the detected temperature.

In view of the above described circumstances, the present invention has an object to provide a circulation type hot water supply device that can reliably identify an abnormality of a heat exchanger when it occurs, such as adhesion of a deposit to an inner surface of a heat absorbing pipe.

SUMMARY OF THE INVENTION

In order to achieve the above described object, the present invention provides a circulation type hot water supply device comprising a water heater having a hot water supply heat exchanger, a burner that heats water supplied to the heat exchanger from a water supply channel upstream of the heat exchanger, and delivered hot water temperature detection means for detecting a temperature of hot water fed from the heat exchanger to a hot water delivering channel downstream of the heat exchanger, a hot water delivering tap being connected to the hot water delivering channel which is connected at the downstream end thereof to the water supply channel, and a circulating pump that returns the hot water fed from the heat exchanger to the hot water delivering channel to the heat exchanger through the water supply channel being provided in the hot water delivering channel, further comprising: a condition determination processing portion that determines whether a first condition that the hot water delivering tap is closed and a second condition that the burner is subjected to combustion are met; and a diagnosis processing portion that diagnoses the presence or absence of an abnormality of the heat exchanger when the condition determination processing portion determines that both the first and second conditions are met, wherein the diagnosis processing portion has a stop processing portion that stops supply of water to the heat exchanger to stop combustion of the burner, and an abnormality determination processing portion that determines the presence of an abnormality in the case where an amount of increase of a detection temperature detected by the delivered hot water temperature detection means reaches a predetermined threshold value or more after the stop processing portion stops the supply of water.

According to the present invention, when the diagnosis processing portion performs a diagnosis, the stop processing portion stops the supply of water to the heat exchanger to stop the combustion of the burner, thereby causing a delayed water temperature increase of the heat exchanger. Thus, if a deposit adheres to an inner surface of a heat absorbing pipe to reduce heat exchange efficiency of the heat exchanger and thus increase a temperature of the heat exchanger itself, the amount of increase of the detection temperature from the delivered hot water temperature detection means after the stop of the supply of water reaches the threshold value or more, and the abnormality determination processing portion determines the presence of an abnormality. Thus, the circulation type hot water supply device can reliably identify an abnormality of the heat exchanger when it occurs.

The delayed water temperature increase occurs even when the heat exchanger is normal. If the threshold value is fixed, with a large combustion amount of the burner immediately before the stop of the supply of water, the amount of increase of the detection temperature from the delivered hot water temperature detection means after the stop of the supply of water may exceeds the threshold value, and the presence of an abnormality may be falsely determined though the heat exchanger is normal. If the threshold value is set to a relatively high value in view of this, with a small combustion amount of the burner, the amount of increase of the detection temperature from the delivered hot water temperature detection means after the stop of the supply of water may become less than the threshold value, and the absence of an abnormality may be falsely determined though an abnormality of the heat exchanger occurs. Thus, the threshold value is preferably variably set according to the combustion amount of the burner at the timing immediately before the stop means stops the supply of water. This can relatively increase the threshold value when the combustion amount of the burner is large, and relatively reduce the threshold value when the combustion amount of the burner is small, thereby preventing false determination.

According to the present invention, the diagnosis processing portion performs the diagnosis only when the first condition that the hot water delivering tap is closed and the second condition that the burner is subjected to combustion are both met. This diagnosis uses a delayed water temperature increase of the heat exchanger, and the second condition is essential to start the diagnosis but the first condition is not essential. However, if the diagnosis is started when the first condition is not met, that is, when the hot water is delivered from the hot water delivering tap, the stop processing portion stops the supply of water to stop the delivery of hot water from the hot water delivering tap, which imposes an inconvenience on a user. Thus, in the present invention, the diagnosis is performed only when the first condition is met.

When the first condition is met, that is, when the hot water delivering tap is closed, hot water is circulated in a closed loop extending from the heat exchanger through the hot water delivering channel and the water supply channel and returning to the heat exchanger. Thus, no running water flows in from an upstream portion of the water supply channel (a portion of the water supply channel upstream of a connection of a downstream end of the hot water delivering channel). On the other hand, when the hot water delivering tap is opened, running water in an amount corresponding to the amount of hot water delivered from the hot water delivering tap flows in from the upstream portion of the water supply channel. Thus, when no running water flows in from the upstream portion of the water supply channel, it can be determined that the first condition is met. In this case, whether the first condition is met can be determined based on a signal from a water flow switch provided in the upstream portion of the water supply channel. However, this requires the water flow switch to increase costs.

The water heater conventionally comprises supplied water temperature detection means for detecting a temperature of water supplied to the heat exchanger. When no running water flows in from the upstream portion of the water supply channel, the hot water is circulated in the closed loop while being heated by the heat exchanger, and thus the temperature of the water supplied to the heat exchanger is maintained at a predetermined temperature or more. On the other hand, when running water flows in from the upstream portion of the water supply channel, the temperature of the water supplied to the heat exchanger is reduced. Thus, when a detection temperature from the supplied water temperature detection means is a predetermined temperature or more, it can be determined that the first condition is met. The condition determination processing portion is thus configured to determine whether the first condition is met based on the detection temperature from the supplied water temperature detection means, which eliminates the need for detection means exclusively for the first condition such as a water flow switch and is cost-effective.

A relatively large amount of delayed water temperature increase is obtained only by combustion of the burner for a certain time or longer to uniformly heat the heat exchanger even if a deposit adheres to the inner surface of the heat absorbing pipe. Thus, the absence of an abnormality may be falsely determined. In order to prevent such false determination, the condition determination processing means is preferably configured to determine that the second condition is met only when the burner is continuously subjected to combustion for a predetermined time or longer.

In the present invention, the stop processing portion may be configured to stop the circulating pump to stop the supply of water to the heat exchanger. Some circulation type hot water supply devices always drive a circulating pump. Such a device requires a control switch for the circulating pump for stopping the circulating pump during a diagnosis, which increases costs. The water heater conventionally comprises a flow rate control valve provided in the water supply channel. If the downstream end of the hot water delivering channel is connected to the portion of the water supply channel upstream of the flow rate control valve, and the stop processing portion is configured to close the flow rate control valve, the supply of water to the heat exchanger can be stopped without stopping the circulating pump. This eliminates the need for adding the control switch for the circulating pump and is cost-effective.

When the diagnosis processing portion performs a diagnosis, the stop processing portion stops the supply of water to the heat exchanger. Thus, no hot water is delivered even if the hot water delivering tap is opened, which may be misconstrued as a failure by a user. In order to avoid such misconstruing, the device preferably comprises a display processing portion that displays that a diagnosis is being performed by the diagnosis processing portion.

DETAILED DESCRIPTION OF THE PREFERRED EMBODIMENTS

Figure 1:
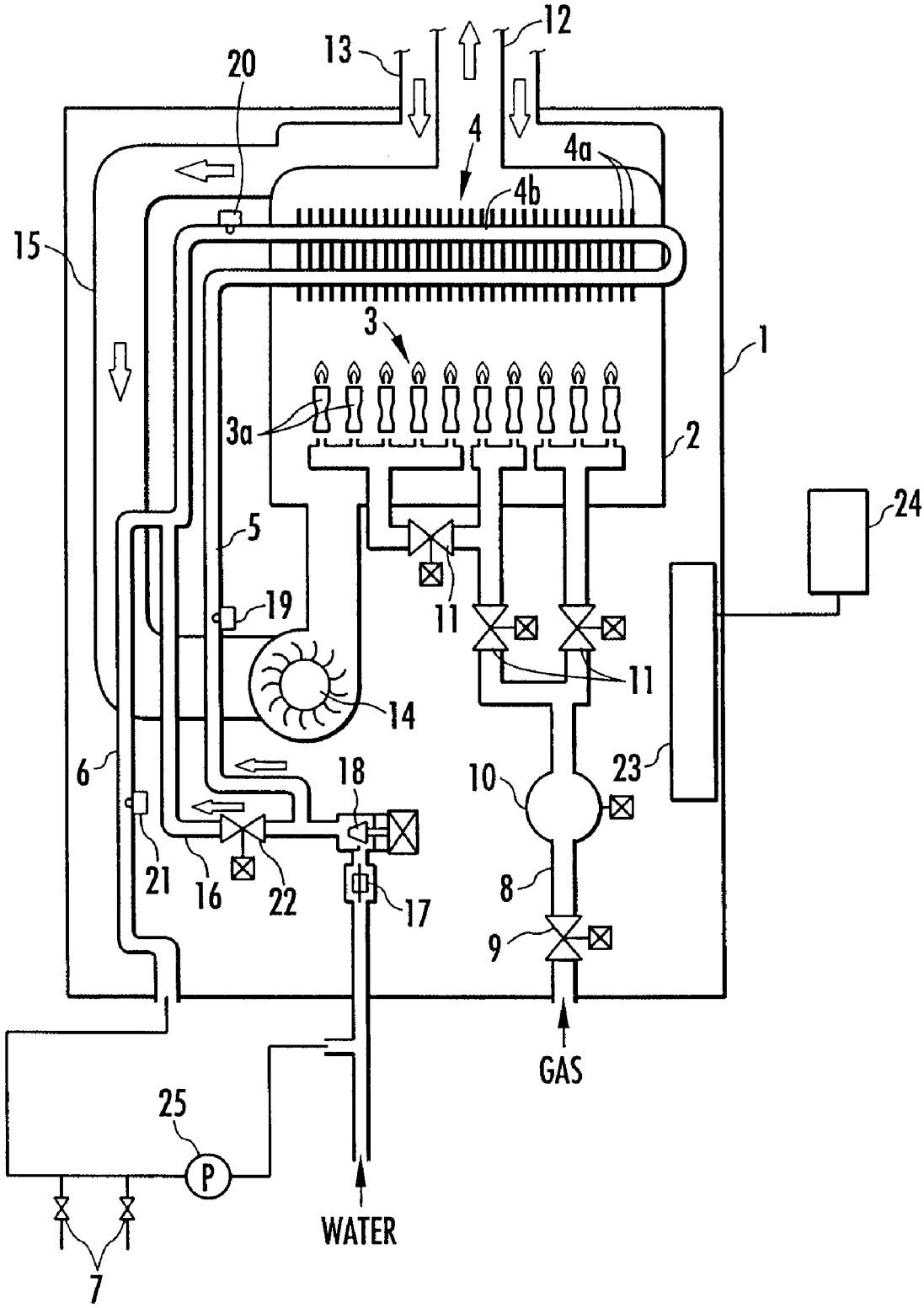
FIG. 1 is a schematic circuit diagram of a hot water supply device according to an embodiment of the present invention.

With reference to FIG. 1, reference numeral 1 denotes a water heater. The water heater 1 includes a housing 2 therein. In the housing 2, a burner 3 constituted by a plurality of unit burners 3*a* is placed, and a hot water supply heat exchanger 4 is placed above the burner 3. The heat exchanger 4 has multiple heat absorbing fins 4*a* and a heat absorbing pipe 4*b* passing through the heat absorbing fins 4*a*. An upstream water supply channel 5 and a downstream hot water delivering channel 6 are connected to the heat absorbing pipe 4*b*. Water supplied from the water supply channel 5 to the heat exchanger 4 is heated in the heat exchanger 4 by heat exchange with combustion exhaust gas of the burner 3. Heated hot water is fed to the hot water delivering channel 6, and delivered from a hot water delivering tap 7 connected to the hot water delivering channel 6.

In a gas supply passage 8 for the burner 3, a main valve 9, a proportional valve 10, and a plurality of switch valves 11 for switching the number of unit burners 3*a* in combustion are provided. The main valve 9 is opened and an ignitor outside the figure is operated to ignite the burner 3. After the ignition, the proportional valve 10 and the switch valves 11 control a combustion amount of the burner 3.

Combustion exhaust gas of the burner 3 passes through the heat exchanger 4, and is then discharged to the outdoors from an upper end of the housing 2 through an exhaust gas cylinder 12. An air supply cylinder 13 surrounding the exhaust gas cylinder 12 is provided. A suction duct 15 connected to a suction side of an air supply fan 14 provided in the water heater 1 is connected to the air supply cylinder 13. The air supply fan 14 is operated to supply outside air through the air supply cylinder 13, the suction duct 15, and the air supply fan 14 into the housing 2 as combustion air.

The water supply channel 5 and the hot water delivering channel 6 are connected via a bypass channel 16 parallel to the heat exchanger 4. In the water supply channel 5, a flow rate sensor 17 and a flow rate control valve 18 are provided upstream of a branch portion of the bypass channel 16. Further, a supplied water temperature sensor 19 as supplied water temperature detection means for detecting a temperature of water supplied to the heat exchanger 4 is provided downstream of the branch portion of the bypass channel 16. In the hot water delivering channel 6, a first hot water delivering temperature sensor 20 as delivered hot water temperature detection means for detecting a temperature of hot water fed from the heat exchanger 4 is provided upstream of a converging portion of the bypass channel 16, and a second hot water delivering temperature sensor 21 is provided downstream of the converging portion of the bypass channel 16. A bypass flow rate control valve 22 is also provided in the bypass channel 16.

Figure 2:
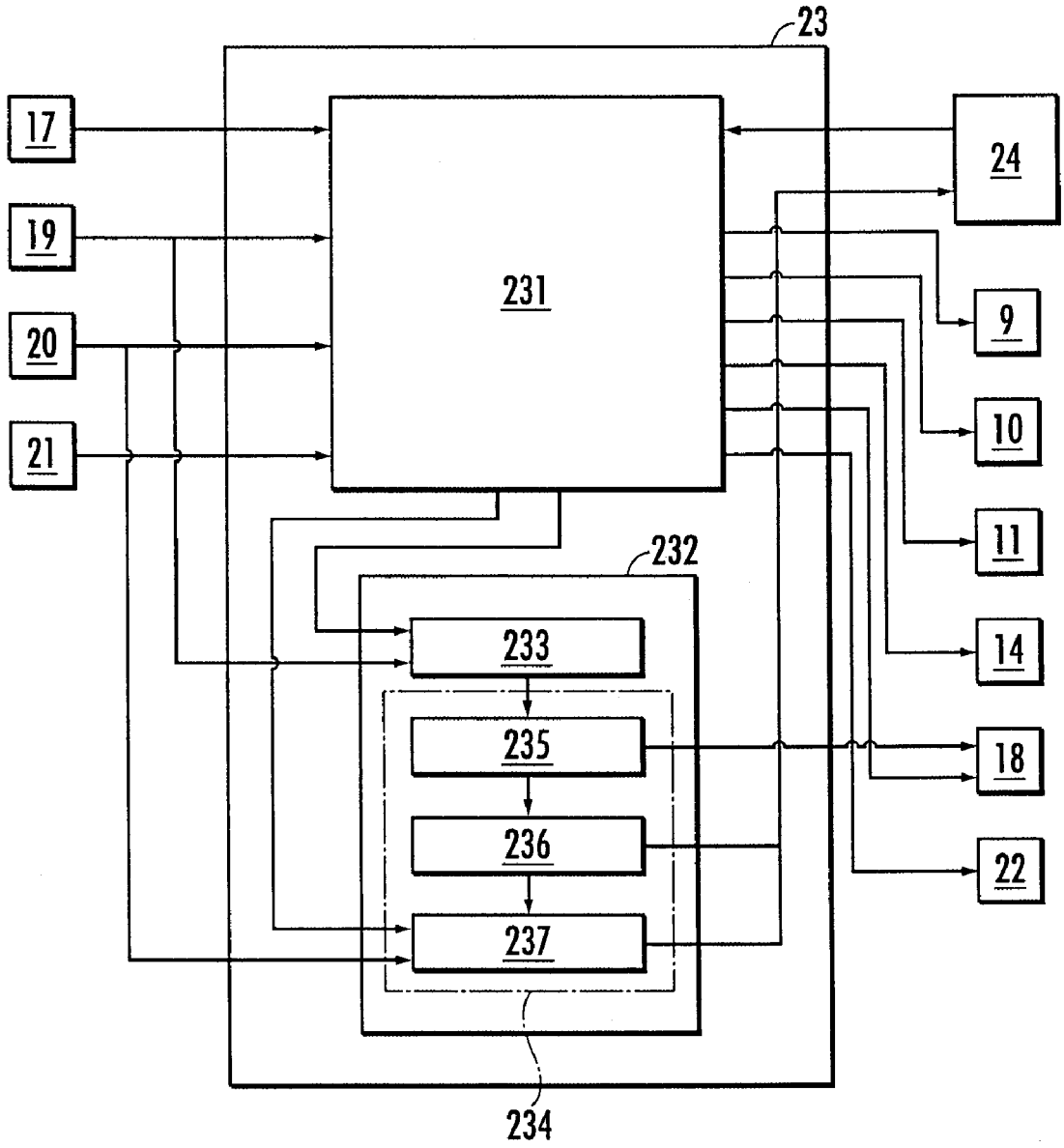
FIG. 2 is a block diagram of a controller provided in the hot water supply device in FIG. 1.

Detection signals from the flow rate sensor 17, the supplied water temperature sensor 19, the first hot water delivering temperature sensor 20, and the second hot water delivering temperature sensor 21 are input to a controller 23 provided in the water heater 1. With reference to FIG. 2, the controller 23 comprises a supplied hot water control portion 231 and a diagnosis control portion 232 described later as functional control portions (control portions configured by programs in a software manner). A command signal of a set hot water temperature set by a remote controller 24 is input to the supplied hot water control portion 231. The supplied hot water control portion 231 controls the main valve 9, the proportional valve 10, the switch valves 11, the air supply fan 14, the flow rate control valve 18, and the bypass flow rate control valve 22 based on the detection signals from the sensors so that a temperature of hot water delivered from the hot water delivering tap 7 reaches the set hot water temperature. This control is known and an outline thereof will be described. The controller 23 opens the main valve 9 to ignite the burner 3 when a detection flow rate from the flow rate sensor 17 reaches a minimum operative flow rate or more. After the ignition, a target combustion amount required for increasing a detection temperature from the second hot water delivering temperature sensor 21 to the set hot water temperature is calculated from a deviation between a detection signal from the second hot water delivering temperature sensor 21 and a detection signal from the supplied water temperature sensor 19 and a detection flow rate from the flow rate sensor 18. Then, the combustion amount of the burner 3 is controlled by feedforward control to the target combustion amount by the proportional valve 10 and the switch valve 11, and the air supply fan 14 is controlled so that combustion air in an amount corresponding to the combustion amount is supplied. Further, a flow rate (a bypass mixing amount) passing through the bypass channel 16 is controlled by the bypass flow rate control valve 22 so that the detection temperature from the first hot water delivering temperature sensor 20 reaches a predetermined high set temperature higher than the set hot water temperature, and the detection temperature from the second hot water delivering temperature sensor 21 becomes equal to the set hot water temperature. If the detection temperature from the second hot water delivering temperature sensor 21 does not reach the set hot water temperature when a maximum combustion amount of the burner 3 is reached, a water supply amount is reduced by the flow rate control valve 18.

In the embodiment, a downstream end of the hot water delivering channel 6 is connected to a portion of the water supply channel 5 upstream of the flow rate sensor 17 and the flow rate control valve 18. A circulating pump 25 that returns hot water fed from the heat exchanger 4 to the hot water delivering channel 6 to the heat exchanger 4 through the water supply channel 5 is provided in the hot water delivering channel 6. The circulating pump 25 is always driven. Thus, water is always supplied to the heat exchanger 4 even when the hot water delivering tap 7 is closed to stop delivery of hot water. The burner 3 is subjected to combustion when the detection temperature from the second hot water delivering temperature sensor 21 reaches less than a predetermined heat insulating hot water temperature set according to the set hot water temperature, and the temperature of the circulated hot water is maintained at the heat insulating hot water temperature. Thus, hot water at an appropriate temperature is delivered immediately after opening of the hot water delivering tap 7, thereby preventing cold water from flowing out immediately after the opening of the hot water delivering tap 7 to cause discomfort to a user.

In areas with high water hardness, $CaCO_3$ or $MgCO_3$ contained in water is deposited in the heat absorbing pipe 4*b* of the heat exchanger 4, and a deposit easily adheres to an inner surface of the heat absorbing pipe 4*b*. Adhesion of the deposit reduces heat exchange efficiency of the heat exchanger 4. This makes it difficult for combustion heat of the burner 3 to be absorbed by water, thereby increasing a temperature of the heat exchanger 4 itself. Repeating combustion in this state causes heat damage to the heat exchanger 4 and thus causes leakage. In the embodiment, the diagnosis control portion 232 of the controller 23 performs diagnosis control so that an abnormality of the heat exchanger 4 can be identified at early stages when it occurs, such as the adhesion of the deposit to the inner surface of the heat absorbing pipe 4*b*. The diagnosis control portion 232 comprises a condition determination processing portion 233 and a diagnosis processing portion 234 configured by Steps S2 and S3 described later. The diagnosis processing portion 234 comprises a stop processing portion 235 configured by Step S4 described later, a display processing portion 236 configured by Step S5 described later, and an abnormality determination processing portion 237 configured by Steps S6 to S14 described later.

Figure 3:
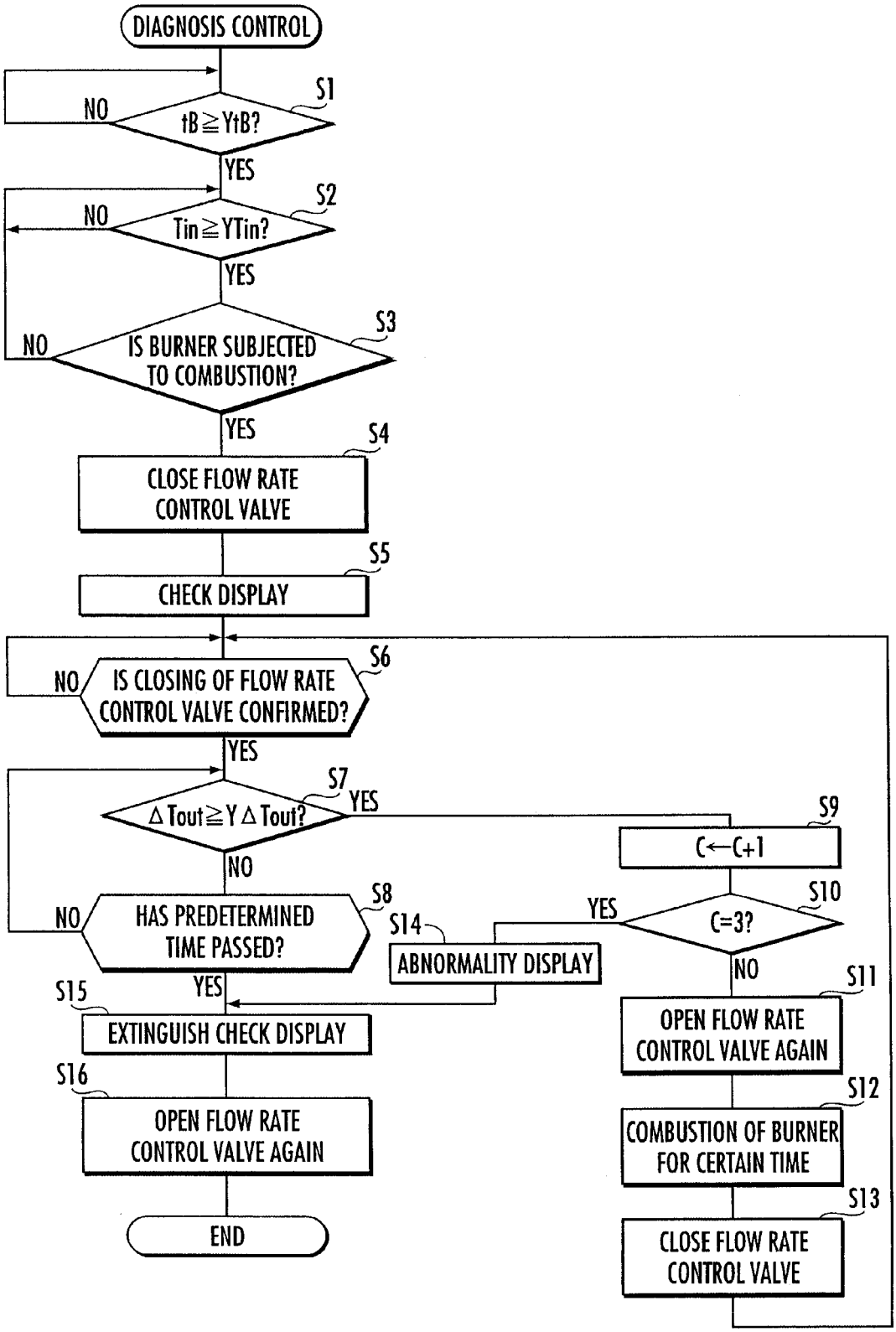
FIG. 3 is a flowchart showing diagnosis control performed by a diagnosis control portion of the controller.

Details of the diagnosis control are as shown in FIG. 3. First in Step S1, it is determined whether a cumulative combustion time tB of the burner 3 after a former diagnosis reaches a predetermined time YtB or longer. When tB is equal to or longer than YtB, it is determined in Step S2 whether the detection temperature Tin from the supplied water temperature sensor 19 is equal to or higher than a predetermined temperature YTin set to be slightly lower than the heat insulating hot water temperature. When Tin is equal to or higher than YTin, it is determined in Step S3 whether the burner 3 is subjected to combustion based on a signal from the supplied hot water control portion 231.

In Step S2, it is determined whether the hot water delivering tap 7 is closed based on the detection temperature Tin from the supplied water temperature sensor 19. When the hot water delivering tap 7 is opened, running water in an amount corresponding to an amount of hot water delivered from the hot water delivering tap 7 flows in from an upstream portion of the water supply channel 5 (a portion of the water supply channel 5 upstream of a connection of a downstream end of the hot water delivering channel 6). Thus, the detection temperature Tin from the supplied water temperature sensor 19 becomes much lower than the heat insulating hot water temperature, and Tin becomes lower than YTin. On the other hand, when the hot water delivering tap 7 is closed, the hot water is circulated in a closed loop extending from the heat exchanger 4 through the hot water delivering channel 6 and the water supply channel 5 and returning to the heat exchanger 4, and no running water flows in from the upstream portion of the water supply channel 5. Thus, the detection temperature Tin from the supplied water temperature sensor 19 is maintained at a temperature substantially equal to the heat insulating hot water temperature, and Tin becomes equal to or higher than YTin.

The determination processings in Steps S2 and S3 are repeated until both the determination results of Steps S2 and S3 become YES. When both the determination results of the Steps S2 and S3 become YES, that is, when Tin is equal to or higher than YTin and the burner 3 is subjected to combustion, the process proceeds to Step S4 and thereafter, and a diagnosis processing is performed.

In the diagnosis processing, first in Step S4, the flow rate control valve 18 is closed. Further, in Step S5, a signal is sent to the remote controller 24, and a "check display" indicating that the diagnosis is being performed is lit in a display portion of the remote controller 24. When the flow rate control valve 18 is closed, the supply of water to the heat exchanger 4 is stopped even if the circulating pump 25 is operated. Then, the detection flow rate from the flow rate sensor 17 reaches a minimum operative flow rate or less, and the combustion of the burner 3 is stopped.

Next, in Step S6, it is confirmed whether the flow rate control valve 18 is actually closed based on a signal from a sensor provided in the flow rate control valve 18. When the closing of the flow rate control valve 18 is confirmed, the process proceeds to Step S7, an amount of increase ΔTout of a detection temperature Tout from the first hot water delivering temperature sensor 20 from the time of confirmation of the closing of the flow rate control valve 18, and it is determined whether the amount of increase ΔTout reaches a predetermined threshold value YΔTout or more. When ΔTout is smaller than YΔTout, it is determined in Step S8 whether a predetermined time (for example, 30 seconds) has passed from the time of confirmation of the closing of the flow rate control valve 18, and the process returns to Step S7 until the predetermined time passes. When the predetermined time passes with ΔTout being smaller than YΔTout, the absence of an abnormality is determined, a signal is sent to the remote controller 24 in Step S15 to extinguish the "check display". Then, in Step S16, the flow rate control valve 18 is opened (in a normal control state) again, and one diagnosis processing is finished.

If a deposit adheres to the inner surface of the heat absorbing pipe 4*b* to reduce heat exchange efficiency of the heat exchanger 4 and thus increase the temperature of the heat exchanger 4 itself, the amount of increase ΔTout of the detection temperature Tout from the first hot water delivering temperature sensor is increased by a delayed water temperature increase after a stop of the supply of water. Thus, if the threshold value YΔTout is set to a value slightly larger than the amount of increase ΔTout when the heat exchanger 4 is normal, it can be determined that the state where ΔTout is equal to or larger than YΔTout is an abnormal state where the deposit adheres to the inner surface of the heat absorbing pipe 4*b*.

A relatively large amount of delayed water temperature increase is obtained only by combustion of the burner 3 for a certain time or longer to uniformly heat the heat exchanger 4 even if the deposit adheres to the inner surface of the heat absorbing pipe 4*b*, and sometimes ΔTout becomes smaller than YΔTout. Thus, it is preferably determined YES in Step S3 to start the diagnosis processing only when the burner 3 is subjected to combustion for a predetermined time (for example, one minute) or longer.

Figure 4:
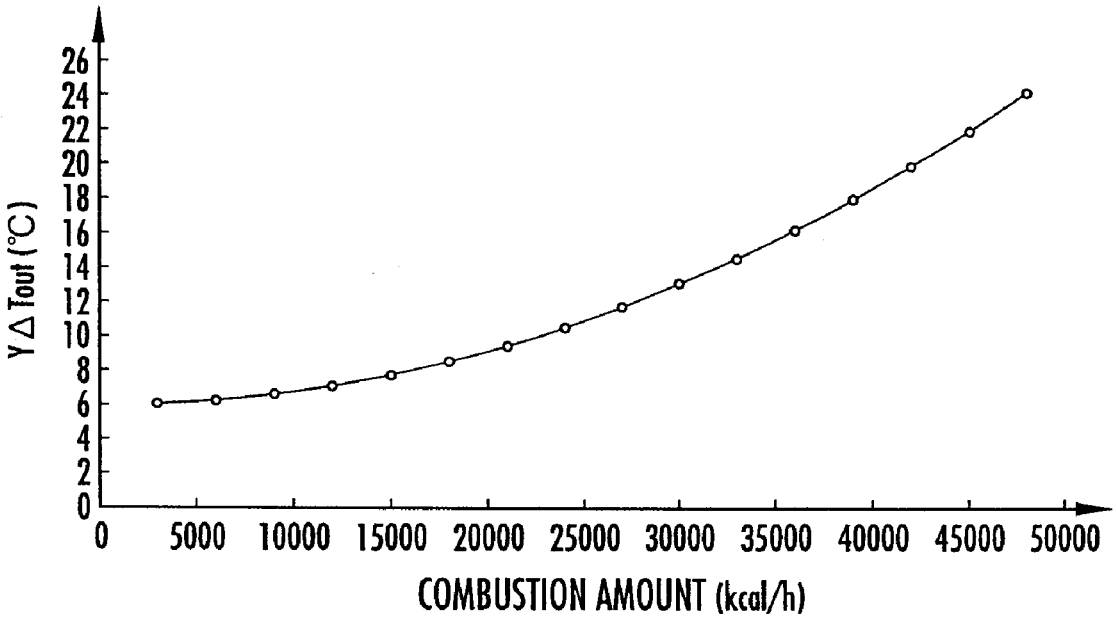
FIG. 4 is a graph showing a relationship between a combustion amount and a threshold value YΔTout for determination of an abnormality.

The amount of increase ΔTout also varies according to the combustion amount of the burner 3 immediately before the stop of the supply of water. If the threshold value YΔTout is fixed, with a large combustion amount of the burner 3 immediately before the stop of the supply of water, ΔTout may become equal to or larger than YΔTout and the presence of an abnormality may be falsely determined though the heat exchanger 4 is normal. If the threshold value YΔTout is set to a relatively high value in view of this, with a small combustion amount of the burner 3, ΔTout may become smaller than YΔTout and the absence of an abnormality may be falsely determined though an abnormality of the heat exchanger 4 occurs. Thus, a data table indicating a relationship between the combustion amount and the threshold value YΔTout as shown in FIG. 4 is prepared and stored in the controller 23. Then, table retrieval is performed of the threshold value YΔTout corresponding to the combustion amount of the burner 3 immediately before the stop of the supply. This can prevent false determination as much as possible.

However, even when ΔTout becomes equal to or larger than YΔTout only once, the possibility of false determination remains. In the embodiment, when it is determined in Step S7 that ΔTout is equal to or larger than YΔTout, one is added to a count value C in Step S9, and then it is determined in Step S10 whether the count value C reaches three. Until the count value C reaches three, the flow rate control valve 18 is opened again in Step S11, the burner 3 is subjected to combustion for a predetermined time (for example, 15 seconds) in Step S12, the flow rate control valve 18 is closed again in Step S13, and the process returns to Step S6, which are repeated. When the count value reaches three, that is, when it is determined three times continuously that ΔTout is equal to or larger than YΔTout, the presence of an abnormality of the heat exchanger 4 is determined, a signal is sent to the remote controller 24 in Step S14, and an abnormality indication that indicates the occurrence of the abnormality is lit in the display portion or the remote controller 24. Then, after the processing in Step S14, the above described processings in S15 and S16 are performed, and one diagnosis processing is finished. The abnormality indication may be not extinguished after the diagnosis processing, and may encourage a user to take an appropriate measure such as cleaning of the heat exchanger 4.

If the diagnosis processing is started while the hot water delivering tap 7 is opened to deliver hot water, the closing of the flow rate control valve 18 in Step S4 stops the delivery of hot water from the hot water delivering tap 7, which imposes an inconvenience on the user. In the embodiment, however, it is determined in Step S2 that Tin is smaller than YTin during the delivery of hot water, thus the process does not proceed to Step S4, and the delivery of hot water is not stopped in midstream. Also, no water is delivered during the diagnosis processing even if the hot water delivering tap 7 is opened, which may be construed as a failure by the user. In the embodiment, however, the "check indication" is lit during the diagnosis processing, thereby preventing the user from misconstruing the situation as a failure.

When the hot water delivering tap 7 is opened to deliver hot water, running water flows in from the upstream portion of the water supply channel 5 (the portion of the water supply channel 5 upstream of the connection of the downstream end of the hot water delivering channel 6), while when the hot water delivering tap is closed, the inflow of the running water from the upstream portion of the water supply channel 5 is stopped. Thus, it can be considered that the flow rate sensor 17 provided in a downstream portion of the water supply channel 5 (a portion of the water supply channel downstream of the connection of the downstream end of the hot water delivering channel 6) is placed in the upstream portion of the water supply channel 5, and whether the hot water delivering tap 7 is closed is determined based on the signal from the flow rate sensor 17. The flow rate sensor 17, however, needs to be provided in the downstream portion of the water supply channel 5 for fail safe in the event of failure of the circulating pump 25. Specifically, when the supply of water to the heat exchanger 4 is stopped by the failure of the circulating pump 25 at the stop of the delivery of hot water, the stop by the failure needs to be detected to prohibit the combustion of the burner 3. Providing the flow rate sensor 17 in the upstream portion of the water supply channel 5 prevents detection of the stop of the supply of water by the failure of the circulating pump 25. Thus, the flow rate sensor 17 has to be provided in the downstream portion of the water supply channel 5. Thus, for directly detecting the supply of running water from the upstream portion of the water supply channel 5, a water flow switch needs to be further provided in the upstream portion of the water supply channel 5, which increases costs. In the embodiment, the existing supplied water temperature sensor 19 can be used to determine whether the hot water delivering tap 7 is closed, which is cost-effective.

In the embodiment, the flow rate control valve 18 is closed in Step S4 to stop the supply of water to the heat exchanger 4, but it can be considered that the circulating pump 25 is stopped to stop the supply of water. However, the circulation type hot water supply device that always drives the circulation pump 25 comprises no control switch for controlling the circulating pump 25 with the controller 23 in the water heater 1. Thus, in order to stop the circulation pump 25 at the start of the diagnosis, the control switch needs to be added, which increases costs. In the embodiment, no control switch needs to be added, which is cost-effective.

The embodiment of the present invention has been described with reference to the drawings, but the present invention is not limited to this. For example, in the embodiment, the supplied water temperature sensor 19 is provided as supplied water temperature detection means for detecting the temperature of the water supplied to the heat exchanger 4, but the supplied water temperature detection means may be configured by the controller 23 in a software manner. Specifically, the supplied water temperature can be calculated by a predetermined arithmetic expression from the combustion amount of the burner 3, the water supply amount detected by the flow rate sensor 17, and the delivered hot water temperature detected by the delivered hot water temperature sensor 21. The calculation is performed by the controller 23 to calculate the supplied water temperature, which allows the supplied water temperature sensor 19 to be omitted.

The water heater 1 in the embodiment is of a bypass mixing type having the bypass channel 16, but a water heater may be used in which the entire amount of water supplied to the water supply channel 5 is supplied to the heat exchanger 4 without providing the bypass channel 16. In this case, the combustion amount of the burner 3 is controlled so that the detection temperature from the delivered hot water temperature sensor 20 reaches the set hot water temperature, which eliminates the need for the second hot water delivering temperature sensor 21.

What is claimed is:

1. A circulation type hot water supply device comprising a water heater having a hot water supply heat exchanger, a burner that heats water supplied to the heat exchanger from a water supply channel upstream of the heat exchanger, and delivered hot water temperature detection means for detecting a temperature of hot water fed from the heat exchanger to a hot water delivering channel downstream of the heat exchanger, a hot water delivering tap being connected to the hot water delivering channel which is connected at the downstream end thereof to the water supply channel, and a circulating pump that returns the hot water fed from the heat exchanger to the hot water delivering channel to the heat exchanger through the water supply channel being provided in the hot water delivering channel, the device further comprising:

a condition determination processing portion that determines whether a first condition that the hot water delivering tap is closed and a second condition that the burner is subjected to combustion are met; and a diagnosis processing portion that diagnoses the presence or absence of an abnormality of the heat exchanger in the case where the condition determination processing portion determines that both the first and second conditions are met, wherein the diagnosis processing portion has a stop processing portion that stops supply of water to the heat exchanger to stop combustion of the burner, and an abnormality determination processing portion that determines the presence of an abnormality in the case where an amount of increase of a detection temperature detected by the delivered hot water temperature detection means reaches a predetermined threshold value or more after the stop processing portion stops the supply of water.

2. The circulation type hot water supply device according to claim 1, wherein said threshold value is variably set according to a combustion amount of said burner at the timing immediately before said stop means stops the supply of water.

3. The circulation type hot water supply device according to claim 1, wherein said device further comprises supplied water temperature detection means for detecting a temperature of water supplied to said heat exchanger through said water supply channel, and said condition determination processing means is configured to determine that said first condition is met in the case where a detection temperature from the supplied water temperature detection means is a predetermined temperature or more.

4. The circulation type hot water supply device according to claim 1, wherein said condition determination processing means is configured to determine that said second condition is met only in the case where said burner is continuously subjected to combustion for a predetermined time or longer.

5. The circulation type hot water supply device according to claim 1, wherein said device further comprises a flow rate control valve provided in said water supply channel, the downstream end of said hot water delivering channel is connected to a portion of the water supply channel upstream of the flow rate control valve, and said stop processing portion is configured to close the flow rate control valve to stop the supply of water to said heat exchanger.

6. The circulation type hot water supply device according to claim 1, wherein said device further comprises a display processing portion that displays that a diagnosis is being performed by said diagnosis processing portion.

* * * * *